US010408507B2

(12) United States Patent
VanTubergen, Jr.

(10) Patent No.: US 10,408,507 B2
(45) Date of Patent: Sep. 10, 2019

(54) SOLAR DRINK HOLDER SYSTEM AND METHOD

(71) Applicant: John William VanTubergen, Jr., Wyoming, MI (US)

(72) Inventor: John William VanTubergen, Jr., Wyoming, MI (US)

( * ) Notice: Subject to any disclaimer, the term of this patent is extended or adjusted under 35 U.S.C. 154(b) by 47 days.

(21) Appl. No.: 15/654,520

(22) Filed: Jul. 19, 2017

(65) Prior Publication Data

US 2018/0051918 A1 Feb. 22, 2018

Related U.S. Application Data

(60) Provisional application No. 62/376,893, filed on Aug. 18, 2016.

(51) Int. Cl.
*F25B 21/02* (2006.01)
*F25D 31/00* (2006.01)
(Continued)

(52) U.S. Cl.
CPC ..... *F25B 27/002* (2013.01); *F25B 21/02* (2013.01); *F25B 21/04* (2013.01); *F25D 31/007* (2013.01); *F25B 2321/0251* (2013.01); *F25D 2331/803* (2013.01); *F25D 2331/805* (2013.01); *F25D 2400/12* (2013.01)

(58) Field of Classification Search
CPC ..... F25B 21/02; F25B 21/04; F25B 2321/02; F25B 2321/021; F25B 2321/0211; F25B 2321/0212; F25B 2321/023; F25B 2321/025; A47G 23/03; A47C 7/68; A47F 3/0491; B60N 3/10; B60N 3/101; B60N 3/102; H05K 2201/10219; H01L 31/04; Y10S 126/906; G06F 17/00; H04B 1/06; H04B 1/38; F25D 3/06; F25D 3/08;
(Continued)

(56) References Cited

U.S. PATENT DOCUMENTS 5,720,171 A 2/1998 Osterhoff et al.
5,842,353 A 12/1998 Kuo-Liang
(Continued)

*Primary Examiner* — Frantz F Jules
*Assistant Examiner* — Erik Mendoza-Wilkenfel
(74) *Attorney, Agent, or Firm* — Integrity Patent Group, PLC; Charles E. Runyan

(57) ABSTRACT

A solar drink holder system includes a hand held thermoelectric temperature controlled beverage receptacle configured to receive and hold a cylindrical beverage container. A Peltier thermoelectric module is coupled to the hand held thermoelectric temperature controlled beverage receptacle and is configured to generate and regulate internal temperature of a beverage held within the cylindrical beverage container. At least one solar panel is hingeably attached to the hand held thermoelectric temperature controlled beverage receptacle. A device body is coupled to the hand held thermoelectric temperature controlled beverage receptacle including a rechargeable power source; a control panel, at least one USB port, at least one digital display, at least one audio speaker, a short range wireless communication protocol, a thermal indicator, said solar drink holder which is configured to provide a solar powered thermally controlled beverage receptacle having electronic device charging and wireless sound transmitting capability.

18 Claims, 5 Drawing Sheets

(51) Int. Cl.
*F25B 27/00* (2006.01)
*F25B 21/04* (2006.01)

(58) Field of Classification Search
CPC .... F25D 31/002; F25D 31/005; F25D 31/007; F25D 31/008
See application file for complete search history.

(56) References Cited

U.S. PATENT DOCUMENTS

| | | | | |
|---|---|---|---|---|
| 9,377,223 | B1 | 6/2016 | Walker | |
| 9,581,384 | B1 * | 2/2017 | Scofield | F25B 21/04 |
| 2007/0131716 | A1 * | 6/2007 | Prabucki | B67D 1/0869 222/146.6 |
| 2009/0025411 | A1 * | 1/2009 | Anderson | F25D 11/003 62/235.1 |
| 2009/0080180 | A1 * | 3/2009 | Bertken | A47G 19/2227 362/101 |
| 2014/0157794 | A1 | 6/2014 | McGann | |
| 2014/0174964 | A1 * | 6/2014 | White | B65D 25/20 206/216 |
| 2015/0245723 | A1 * | 9/2015 | Alexander | A47G 19/027 99/483 |
| 2015/0300727 | A1 * | 10/2015 | Abbate | H04B 1/086 62/331 |

* cited by examiner

SOLAR DRINK HOLDER SYSTEM AND METHOD

CROSS-REFERENCE TO RELATED APPLICATION(S)

The present application is related to and claims priority to U.S. Provisional Patent Application No. 62/376,893 filed Aug. 18, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

Technical Field

The present invention relates generally to the field of beverage holders of existing art and more specifically relates to a thermoelectric temperature controlled beverage holder.

Related Art

As society advances more and more people have come to expect technology to be integrated into the accoutrements of their day to day lives. For example, people desire the ability to charge their cell phone at any given moment, regardless of location. Additionally, people prefer their hot beverages to remain hot and cold beverages to remain cold regardless of ambient environmental conditions. Koozies may keep a beverage cool for a limited duration but are not suitable for longer periods of time. A Thermos® may be used as an insulating storage vessel that greatly lengthens the time over which its contents remain hotter or cooler than the flask's surroundings. Invented by Sir James Dewar in 1892, the Thermos consists of two flasks, placed one within the other and joined at the neck. The gap between the two flasks is partially evacuated of air, creating a near-vacuum which significantly reduces heat transfer by conduction or convection. Thermoses are not multi-purpose by nature. A suitable solution is desired.

U.S. Pub. No. 2009/0038317 to Robert W. Otey relates to a thermoelectric temperature-controlled container holder and method. The described thermoelectric temperature-controlled container holder and method includes a thermoelectric-based container holder having a receptacle with a recess for receiving a container to be heated or cooled, a variable interface surface disposed within the holder and configured to flexibly contact an outside surface of the container to be heated or cooled where the variable surface interface is in thermal contact with the surface of the receptacle, and a thermoelectric assembly thermally connected to at least the variable surface interface.

SUMMARY OF THE INVENTION

In view of the foregoing disadvantages inherent in the known beverage holder art, the present disclosure provides a novel solar drink holder system and method. The general purpose of the present disclosure, which will be described subsequently in greater detail, is to provide an efficient means for controlling beverage temperature via a solar drink holder system and method.

A solar drink holder system and method is disclosed herein. The solar drink holder system includes a hand held thermoelectric temperature controlled beverage receptacle configured to receive and hold a cylindrical beverage container. A Peltier thermoelectric module is coupled to the hand held thermoelectric temperature controlled beverage receptacle and is configured to regulate internal temperature (heat or cool as desired as user-controlled) of a beverage held within the cylindrical beverage container. Other non-cylindrical shapes may be held in alternate embodiments.

At least one solar panel is hingeably attached to the hand held thermoelectric temperature controlled beverage receptacle. A device body coupled to the hand held thermoelectric temperature controlled beverage receptacle including a rechargeable power source (able to store power captured or collected to power the device via solar energy), a control panel, at least one USB port, at least one digital display, at least one audio speaker, a short range wireless communication protocol, a reversible thermal indicator, said solar drink holder which is configured to provide a solar powered thermally controlled beverage receptacle having electronic device charging and wireless sound transmitting capability.

According to another embodiment, a solar drink holder system and method is also disclosed herein. The method includes the steps of, positioning at least one solar panel into a deployed position, connecting an electronic device to be charged to the USB port, activating wireless communication protocol, transmitting wireless sound, and inserting the beverage container into the hand held thermoelectric temperature controlled beverage receptacle.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a solar drink holder system and method, constructed and operative according to the teachings of the present disclosure.

The various embodiments of the present invention will hereinafter be described in conjunction with the appended drawings, wherein like designations denote like elements.

DETAILED DESCRIPTION

Figure 1:
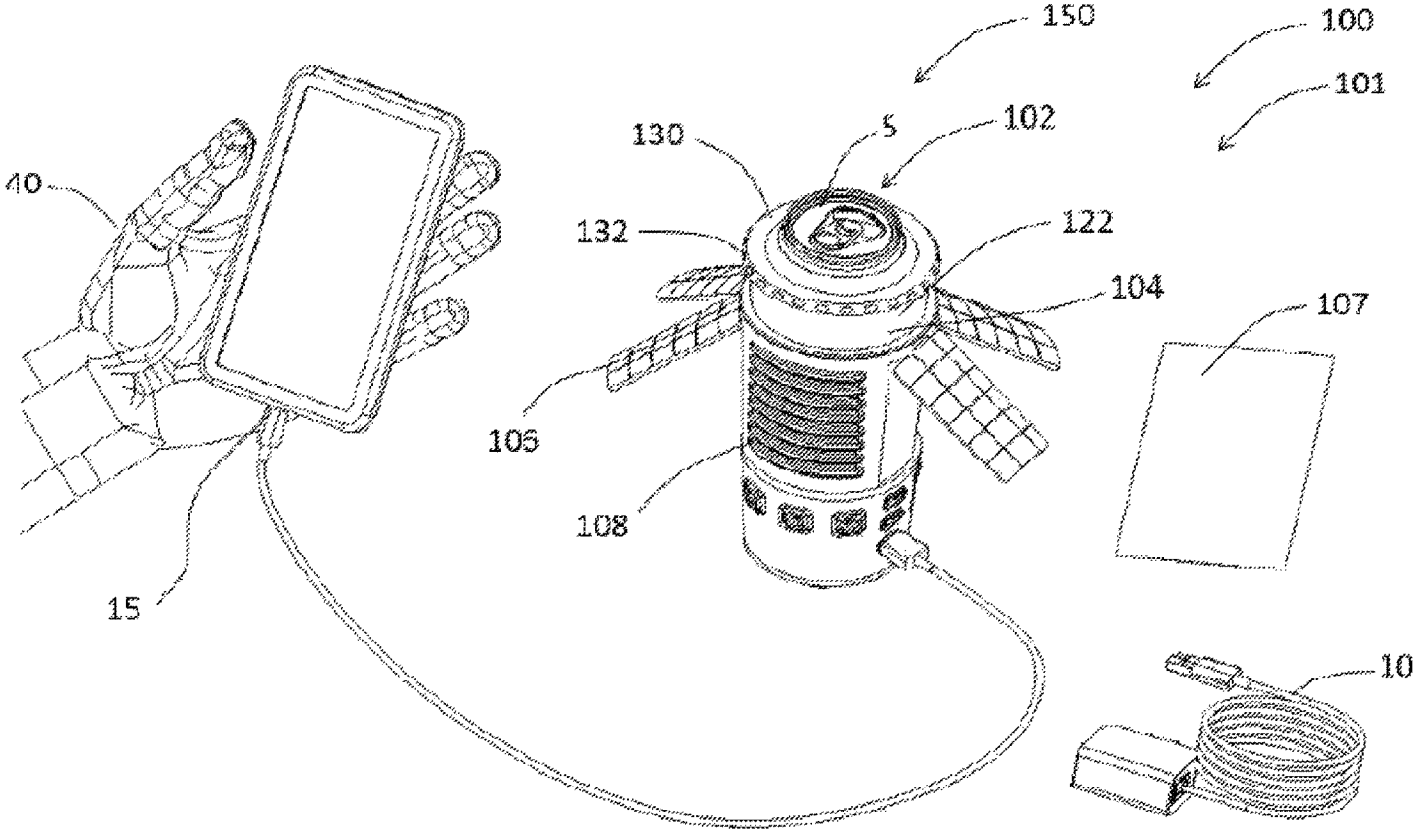
FIG. 1 is a perspective view of the solar drink holder system during an 'in-use' condition, according to an embodiment of the disclosure.

As discussed above, embodiments of the present disclosure relate to a beverage holder and more particularly to a solar drink holder system and method as used to improve the efficiency of heating and cooling beverages via a handheld device.

Generally speaking, the present invention comprises both a solar-powered, refrigerated outer shell and Peltier thermoelectric cooler module for keeping beverages cool (or alternately heated; elevated in temperature). The device includes USB charging ports for charging cell phones and other electronic devices. It plays amplified music via a built-in speaker and short-range wireless communication protocol. This displays the current beverage temperature via numerical display and/or colored indicator. The present invention allows hot beverages to remain hot and cold beverages to remain cold regardless of the ambient temperature.

The Peltier module enables the main functionality of this present device, which is to cool (or heat) and maintain (or generate energy as necessary) an inserted beverage (stored within a container) at a desired temperature range. The speakers are the second main feature of the device, which allows users to connect to and play music through the device. The bottom-most USB port enables charging of the device from a wall (AC) outlet, while the other two enable the charging of 3rd party devices.

The cooling chamber and beverage holders are also key components as they enable the beverage/container to be inserted into the device, and hold it in place. They are effectively necessary to facilitate the main function of this described device. Solar Panels enable additional charge to be collected and transferred as an energy source into the device, mainly for 'emergency charging' of phones, compatible devices etc. when there are no wall outlets readily available.

Aluminum fins may be used to dissipate the heat generated as a by-product of the Peltier Module. It is crucial that they are operational to ensure that device achieves peak performance. Cooling fans work with the aluminum fins to dissipate heat generated by the Peltier Module. The ventilation works with the cooling fan and heat dissipation fins to ensure that the device achieves peak performance, and the proper cooling of inserted beverages. The cooling fan, heat dissipation fins and ventilation outlets are preferably housed in the device body.

A printed circuit board (PCB) governs the functionality of all electronic components including beverage temperature, input power, information displayed on LCD etc. Firmware is also programmed into the PCB. The Li-ion rechargeable battery is required for the device to achieve its main functionalities. Other batteries may be used. Tentatively, the use of either a 16 or 12-cell 18500 or 18650 cells will be used to achieve the power requirements of the device in preferred embodiments. Those with ordinary skill in the art will now appreciate that upon reading this specification and by their understanding the art of printed circuit board and computer-related control means as described herein, methods of control will be understood by those knowledgeable in such art.

The body holds all the components of the device in stasis. Preferred material used is plastic, either ABS or ABS+ Nylon. Pivoting connectors may be required for the solar panels to move in an up/down manner, enabling the optimal positioning of the panels to absorb sunlight in order to charge the present device.

The LCD display is used to show parameters including but not limited to current temperature, time, battery charge and connection status of USB ports. A lens serves as a protective cover for the LCD display. The lens material is preferably Poly Carbonate (PC) or Acrylic. Buttons provided serve as controls for the LCD display.

Referring now more specifically to the drawings by numerals of reference, there is shown in FIGS. 1-4, various views of a solar drink holder system 100.

FIG. 1 shows a solar drink holder system 100 during an 'in-use' condition 150, according to an embodiment of the present disclosure. Here, the solar drink holder system 100 may be beneficial for use by a user 40 to provide a solar powered thermally controlled beverage receptacle 102 having electronic device charging and wireless sound transmitting capability. As illustrated, the solar drink holder system 100 may comprise: a hand held thermoelectric temperature controlled beverage receptacle 102, configured to receive and hold a cylindrical beverage container 5, a Peltier thermoelectric module 104 shown in detail in FIG. 2, coupled to the hand held thermoelectric temperature controlled beverage receptacle 102 and further configured to regulate internal temperature of a beverage held within the cylindrical beverage container 5.

At least one solar panel 106 may be hingeably attached to the hand held thermoelectric temperature controlled beverage receptacle 102, and may include a device body 108 coupled to the hand held thermoelectric temperature controlled beverage receptacle 102. In the preferred embodiment the solar (powered) drink holder 101 may be configured to provide a solar powered thermally controlled beverage receptacle 102 having electronic device 15 charging and wireless sound transmitting capability.

According to one embodiment, the solar drink holder system 100 may be arranged as a kit 105. In particular, the solar drink holder system 100 may further include a set of instructions 107 and a wall (AC) outlet charger 10. The instructions 107 may detail functional relationships in relation to the structure of the solar drink holder system 100 such that the solar drink holder system 100 can be used, maintained, or the like, in a preferred manner.

Figure 2:
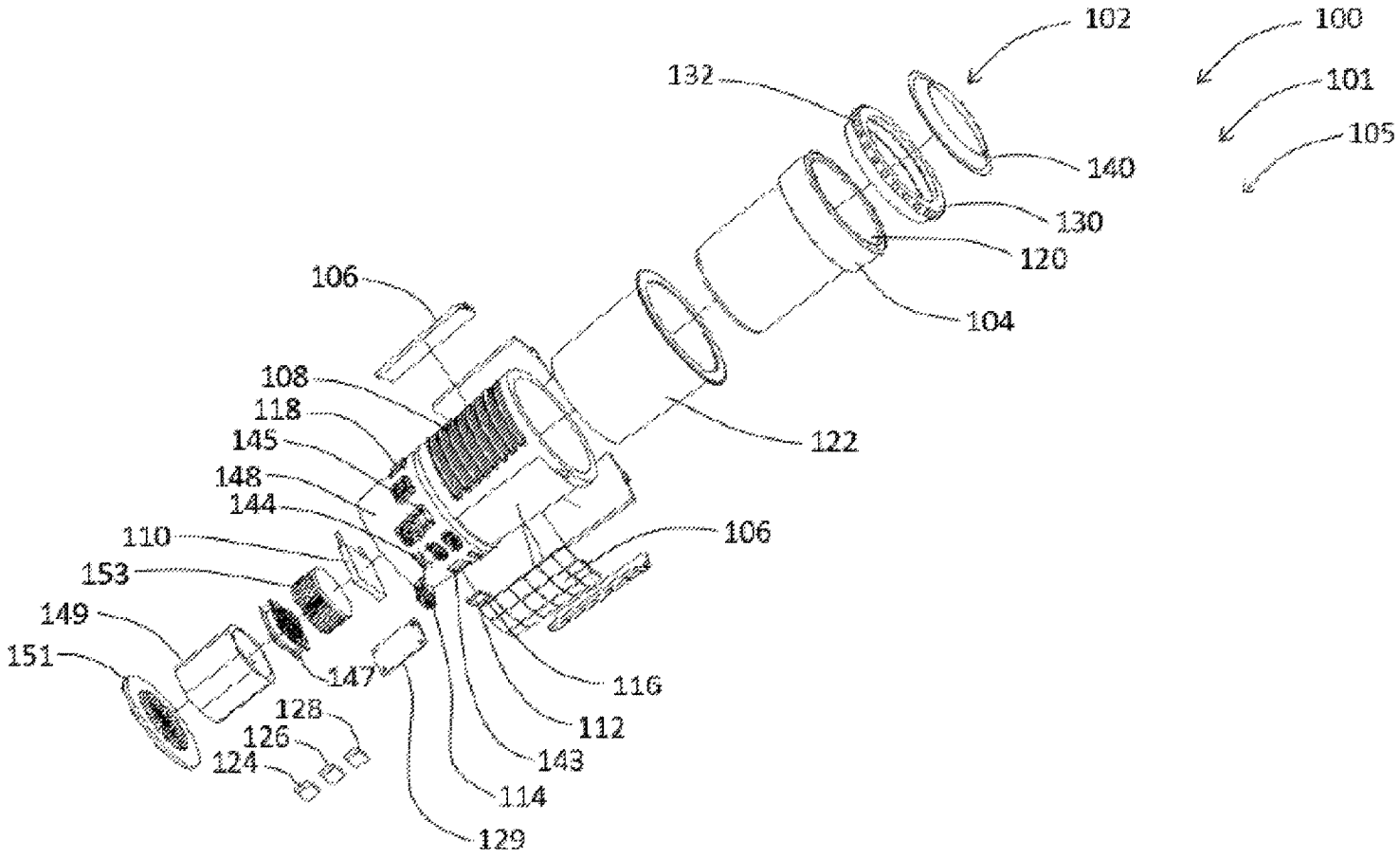
FIG. 2 is an exploded view of the solar drink holder system of FIG. 1, according to an embodiment of the present disclosure.

FIG. 2 shows an exploded view of the solar drink holder system 100 of FIG. 1, according to an embodiment of the present disclosure. In this embodiment the hand held thermoelectric temperature controlled beverage receptacle 102 is a thermal receptacle housing 120 having a first-internal-cylindrical-volume that is open at a top for receiving the cylindrical beverage container 5. The Peltier thermoelectric module 104 is interfaced with the thermal receptacle housing 120 having the first-internal-cylindrical-volume, and the thermal receptacle housing 120 is coupled to a slightly larger external cylindrical shroud 122 having a second-internal-cylindrical-volume and may be arranged to provide a ventilation chamber between the thermal receptacle housing 120 having the first-internal-cylindrical-volume and the external cylindrical shroud 122 having a second-internal-cylindrical-volume.

Figure 3:
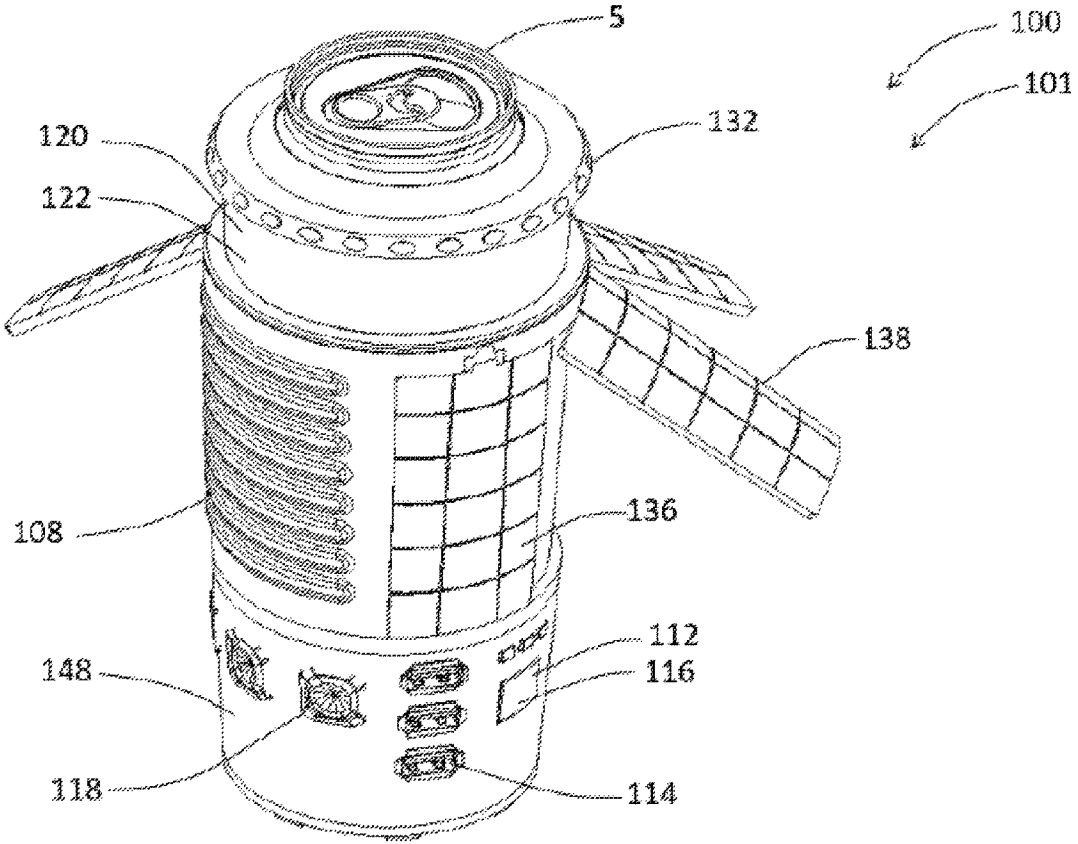
FIG. 3 is a top view of the solar drink holder system of FIG. 1, according to an embodiment of the present disclosure.

The thermal receptacle housing 120 has the first-internal-cylindrical-volume and the external cylindrical shroud 122 has the second-internal-cylindrical-volume which may be coupled together about a top-surface via a solar panel mounting collar 130 and may further include a plurality of ventilating apertures 132. Additionally the solar panel mounting collar 130 should be configured to hingeably attach at least one solar panel 106 which is movable from a stowed position 136 to a deployed position 138 and back to the stowed position 136, as desired as shown in FIG. 3. The at least one solar panel 106 may be mounted to solar panel mounting collar 130 or may be mounted to the device body 108.

The solar panel mounting collar 130 may further be configured to receive and support a cylindrical beverage container seal 140. The device body 108 is structured and arranged to receive the thermal receptacle housing 120 and the external cylindrical shroud 122 coupled together in a nesting configuration.

A hollow base housing 148 is preferably coupled to the device body 108 and may include a rechargeable power source 110; the hollow base housing 148 may be configured to include at least a first-mounting-aperture 143 useful for mounting the control panel 112 that may include a digital display 116. The hollow base housing 148 may also include at least a second-mounting-aperture 144 for at least one USB port 114, and the hollow base housing 148 includes at least a third-mounting-aperture 145 and at least one audio speaker 118.

Additionally the hollow base housing 148 further includes a Peltier thermoelectric module 104 cooling system comprising a heat sink 153, cooling fan 147, and fan chamber 149. The hollow base housing 148 has a ventilated base housing bottom closure 151. The device body 108 may be further configured internally to receive and support the short range wireless communication protocol module 124, a central processing unit (CPU) 126 module and a random access memory (RAM) 128 module that may be integrated into a printed circuit board (PCB) 129 in working combination to provide system management.

FIG. 3 is a top view of the solar drink holder system 100 of FIG. 1, according to an embodiment of the present disclosure.

In addition to the preferred embodiment of the solar drink holder system 100 an alternative configuration may provide a hand held thermoelectric temperature controlled beverage receptacle 102 which may be a solar (powered) drink holder 101 comprising: a hand held thermoelectric temperature controlled beverage receptacle 102 configured to receive and hold a cylindrical beverage container 5, may also include a Peltier thermoelectric module 104 as illustrated in FIG. 2 coupled to the hand held thermoelectric temperature controlled beverage receptacle 102 and configured to regulate internal temperature of a beverage held within the cylindrical beverage container 5.

At least one solar panel 106 is hingeably attached to the hand held thermoelectric temperature controlled beverage receptacle 102 which is movable from a stowed position 136 to a deployed position 138 and back to the stowed position 136 as desired. In this alternative configuration the solar drink holder system 100 may be configured such that the device body 108 may also provide additional storage and mounting features for operating components, including but not limited to or illustrated, a rechargeable power source 110, a control panel 112, at least one USB port 114, at least one digital display 116, at least one audio speaker 118, a short range wireless communication protocol module 124, a thermal indicator and may also be configured to provide a solar (powered) drink holder 101 comprising a thermally controlled beverage receptacle having electronic device 15 charging and wireless sound transmitting capability.

Figure 4:
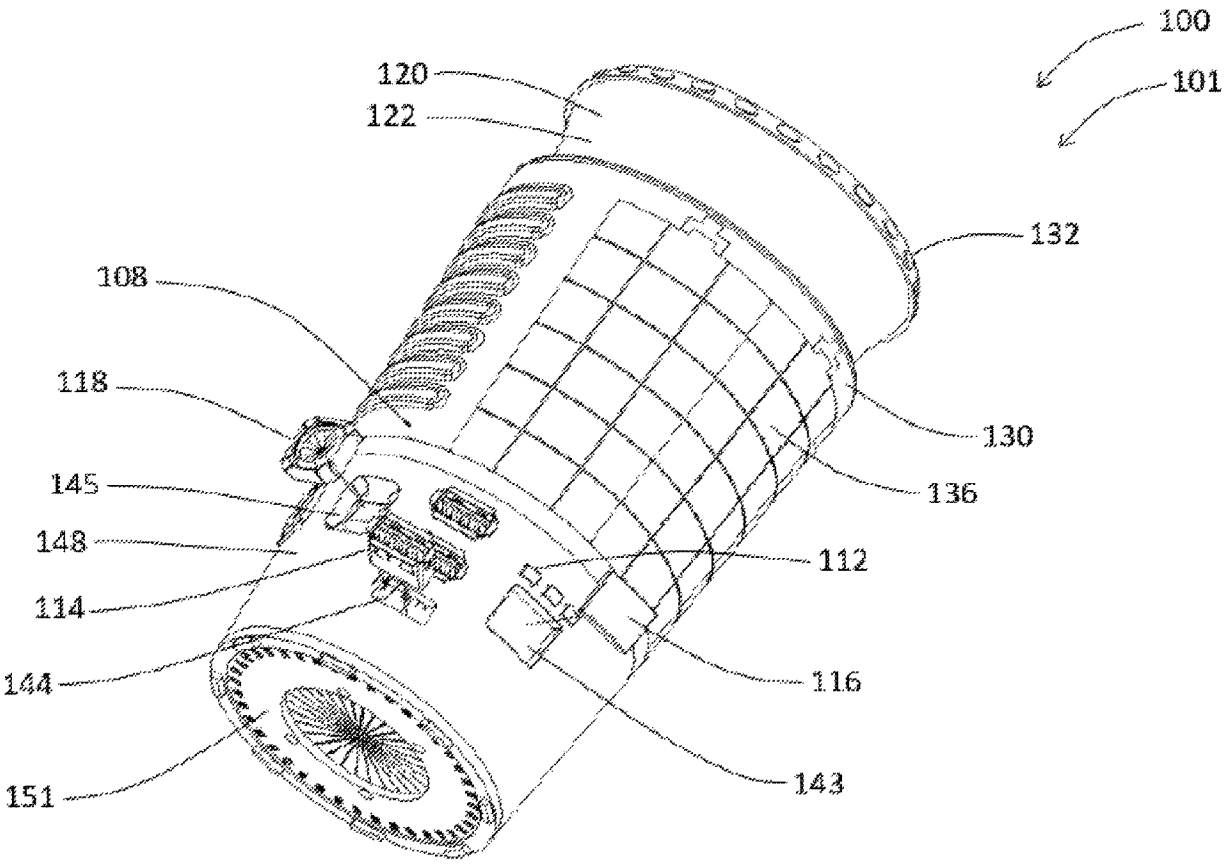
FIG. 4 is a bottom view of the solar drink holder system of FIG. 1, according to an embodiment of the present disclosure.

FIG. 4 is a bottom view of the solar drink holder system 100 of FIG. 1, according to an embodiment of the present disclosure. A solar drink holder 101 is a solar powered thermally controlled beverage receptacle 102 having electronic device 15 charging and wireless sound transmitting capability. The device body 108 includes a solar panel mounting collar 130 that may further include a plurality of ventilating apertures 132. The device body 108 is structured and arranged to receive the thermal receptacle housing 120 and the external cylindrical shroud 122 coupled together in a nesting configuration and a hollow base housing 148 may be configured to include operational components. Upon reading this specification, it should be appreciated that, under appropriate circumstances, considering such issues as user preferences, design preference, structural requirements, marketing preferences, cost, available materials, technological advances, etc., other configuration arrangements such as, for example, module placement, battery type, use of various operational components etc., may be sufficient.

A hollow base housing 148 is coupled to the device body 108 and may be configured to include at least a first-mounting-aperture 143 useful for mounting the control panel 112 that may include a digital display 116. The hollow base housing 148 may also include at least a second-mounting-aperture 144 for at least one USB port 114, and the hollow base housing 148 includes at least a third-mounting-aperture 145 and at least one audio speaker 118. The hollow base housing 148 may also include a ventilated base housing bottom closure 151.

Figure 5:
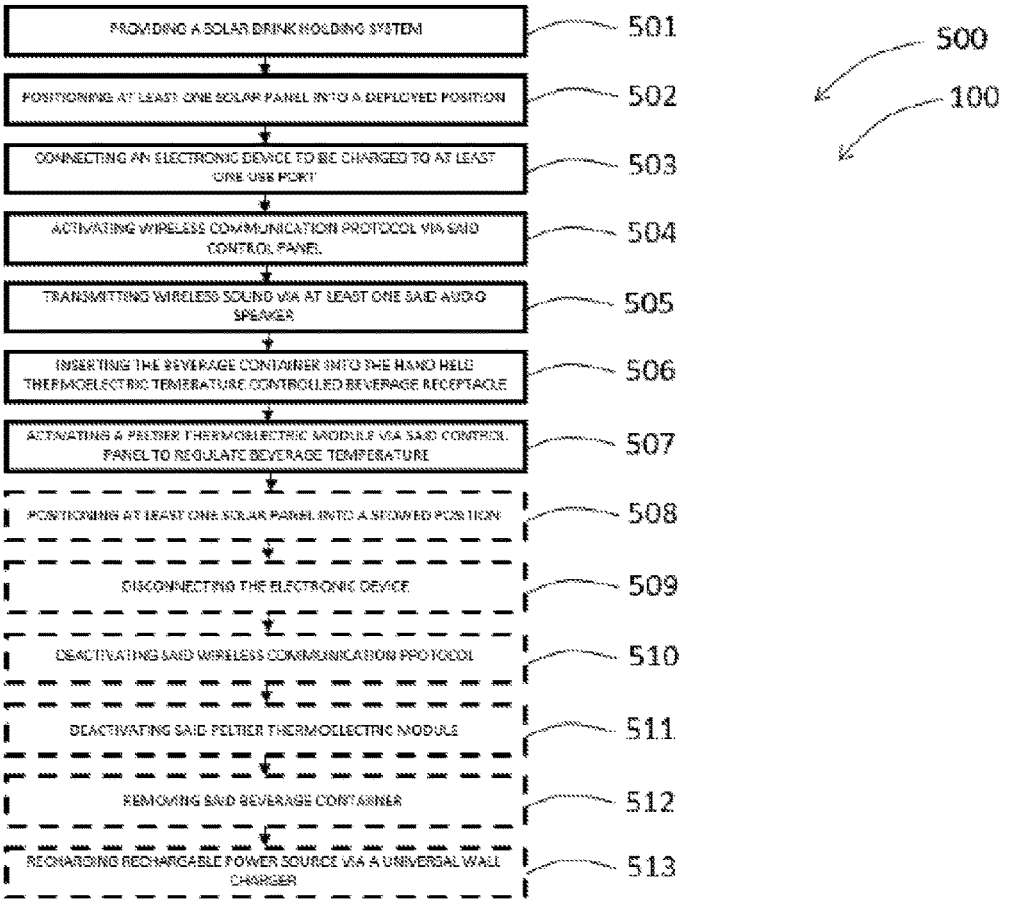
FIG. 5 is a flow diagram illustrating a method of use for the solar drink holder system, according to an embodiment of the present disclosure.

FIG. 5 is a flow diagram illustrating a method 500 for solar drink holder system 100, according to an embodiment of the present disclosure. In particular, the method 500 for solar drink holder system 100 may include one or more components or features of the solar drink holder system 100 as described above. As illustrated, the method 500 for solar drink holder system 100 may include the steps of: step one 501, providing a solar drink holder including a hand held thermoelectric temperature controlled beverage receptacle configured to receive and hold a cylindrical beverage container; a Peltier thermoelectric module coupled to the hand held thermoelectric temperature controlled beverage receptacle and configured to regulate internal temperature of a beverage held within the cylindrical beverage container; at least one solar panel hingeably attached to the hand held thermoelectric temperature controlled beverage receptacle; and a device body coupled to the hand held thermoelectric temperature controlled beverage receptacle including a rechargeable power source, a control panel, at least one USB port, at least one digital display, at least one audio speaker, a short range wireless communication protocol, a reversible thermal indicator and configured to provide a solar powered thermally controlled beverage receptacle having electronic device charging and wireless sound transmitting capability; step two 502, positioning the at least one solar panel into a deployed position; step three 503, connecting an electronic device to be charged to the at least one USB port; step four 504, activating wireless communication protocol via the control panel; step five 505, transmitting wireless sound via the at least one audio speaker; step six 506, inserting the beverage container into the hand held thermoelectric temperature controlled beverage receptacle; step seven 507, activating a Peltier thermoelectric module via the control panel to regulate beverage temperature; step eight 508, positioning the at least one solar panel into a stowed position; step nine 509, disconnecting the electronic device; step ten 510, deactivating the wireless communication protocol; step eleven 511, deactivating the Peltier thermoelectric module; step twelve 512, removing the beverage container; and step thirteen 513, recharging rechargeable power source via a universal wall charger. It should be noted that some of the steps are optional steps (in dashed lines) and may not be implemented in all cases. It should also be noted that the steps described in the method of use can be carried out in many different orders according to user preference. The use of "step of " should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for solar drink holder system those with ordinary skill in the art will now appreciate that upon reading this specification and by their understanding of the art of thermoelectric temperature controlled beverage holder as described herein, methods of using optional features in conjunction or singularly will be understood by those knowledgeable in such art, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A solar drink holder system, the solar drink holder system having a solar drink holder comprising:

a cylindrical device body, having a top and a bottom, which receives a hand held thermoelectric temperature controlled beverage receptacle configured to receive and hold only a single cylindrical beverage container;

a Peltier thermoelectric module coupled to said hand held thermoelectric temperature controlled beverage receptacle and configured to regulate internal temperature of a beverage held within said single cylindrical beverage container;

at least one solar panel attached to said cylindrical device body receiving the hand held thermoelectric temperature controlled beverage receptacle; and a hollow base housing coupled to the bottom of the cylindrical device body said hollow base housing including a rechargeable power source, a control panel, at least one USB port, at least one digital display, at least one audio speaker, a short range wireless communication protocol system, a thermal indicator, said at least one solar panel configured to provide power to the hand held thermoelectric temperature controlled beverage receptacle, the hollow base housing having electronic device charging and wireless sound transmitting capability using the short range wireless communication protocol system.

2. The solar drink holder system of claim 1, wherein said hand held thermoelectric temperature controlled beverage receptacle is a thermal receptacle housing having a first-internal-cylindrical-volume that is open at a top for receiving said single cylindrical beverage container.

3. The solar drink holder system of claim 2, wherein said Peltier thermoelectric module is interfaced with said thermal receptacle housing having said first-internal-cylindrical-volume.

4. The solar drink holder system of claim 2, wherein said thermal receptacle housing is coupled to an external cylindrical shroud having a second-internal-cylindrical-volume and providing a ventilation chamber between said thermal receptacle housing having the first-internal-cylindrical-volume and said external cylindrical shroud having the second-internal-cylindrical-volume, wherein the second-internal-cylindrical-volume is slightly larger than said first-internal-cylindrical-volume.

5. The solar drink holder system of claim 4, wherein said thermal receptacle housing having said first-internal-cylindrical-volume and said external cylindrical shroud having said second-internal-cylindrical-volume are coupled together about a top-surface via a solar panel mounting collar having a plurality of ventilating apertures.

6. The solar drink holder system of claim 5, wherein said solar panel mounting collar is configured to attach said at least one solar panel which is movable from a stowed position to a deployed position and back to said stowed position, as desired.

7. The solar drink holder system of claim 5, wherein said solar panel mounting collar is further configured to receive and support a cylindrical beverage container seal.

8. The solar drink holder system of claim 4, wherein said cylindrical device body is structured and arranged to receive said thermal receptacle housing and said external cylindrical shroud coupled together in a nesting configuration.

9. The solar drink holder system of claim 1 wherein said hollow base housing includes at least a first-mounting-aperture and said control panel with said at least one digital display.

10. The solar drink holder system of claim 1 wherein said hollow base housing includes at least a second-mounting-aperture and said at least one USB port.

11. The solar drink holder system of claim 1 wherein said hollow base housing includes at least a third-mounting-aperture for mounting said at least one audio speaker.

12. The solar drink holder system of claim 1 wherein said hollow base housing further includes a Peltier cooling system comprising a heat sink, cooling fan and fan chamber.

13. The solar drink holder system of claim 1, wherein said hollow base housing has a ventilated base housing bottom closure.

14. The solar drink holder system of claim 1, wherein said hollow base housing is further configured internally to receive and support said short range wireless communication protocol module, a central processing unit (CPU) module and a random access memory module (RAM) in working combination.

15. A solar drink holder system, the solar drink holder system having a solar drink holder comprising:

a cylindrical device body, having a top and a bottom, which receives a hand held thermoelectric temperature controlled beverage receptacle configured to receive and hold only a single cylindrical beverage container;

a Peltier thermoelectric module coupled to said hand held thermoelectric temperature controlled beverage receptacle and configured to regulate internal temperature of a beverage held within said single cylindrical beverage container, at least one solar panel attached to said cylindrical device body receiving the hand held thermoelectric temperature controlled beverage receptacle; and a hollow base housing coupled to the bottom of the cylindrical device body said hollow base housing including a rechargeable power source, a control panel, at least one USB port, at least one digital display, at least one audio speaker, a short range wireless communication protocol system, a thermal indicator, said at least one solar panel configured to provide power to the hand held thermoelectric temperature controlled beverage receptacle, the hollow base housing having electronic device charging and wireless sound transmitting capability using the short range wireless communication protocol system;

wherein said hand held thermoelectric temperature controlled beverage receptacle is a thermal receptacle housing having a first-internal-cylindrical-volume that is open at a top for receiving said single cylindrical beverage container;

wherein said Peltier thermoelectric module is interfaced with an exterior of said thermal receptacle housing having said first-internal-cylindrical-volume;

wherein said thermal receptacle housing is coupled to an external cylindrical shroud having a second-internal-cylindrical-volume and providing a ventilation chamber between said thermal receptacle housing having said first-internal-cylindrical-volume and said external cylindrical shroud having said second-internal-cylindrical-volume, wherein the second-internal-cylindrical-volume is slightly larger than said first-internal-cylindrical-volume;

wherein said thermal receptacle housing having said first-internal-cylindrical-volume and said external cylindrical shroud having said second-internal-cylindrical-volume are coupled together about a top-surface via a solar panel mounting collar having a plurality of ventilating apertures;

wherein said solar panel mounting collar is configured to attach said at least one solar panel which is movable from a stowed position to a deployed position and back to said stowed position, as desired;

wherein said solar panel mounting collar is further configured to receive and support a cylindrical beverage container seal;

wherein said cylindrical device body is structured and arranged to receive said thermal receptacle housing and said external cylindrical shroud coupled together in a nesting configuration;

wherein said hollow base housing includes at least a first-mounting-aperture and said control panel with said at least one digital display;

wherein said hollow base housing includes at least a second-mounting-aperture for mounting said at least one USB port;

wherein said hollow base housing includes at least a third-mounting-aperture for mounting said at least one audio speaker;

wherein said hollow base housing further includes a Peltier cooling system comprising a heat sink, cooling fan, and fan chamber;

wherein said hollow base housing has a ventilated base housing bottom closure; and wherein said hollow base housing is further configured internally to receive and support said short range wireless communication protocol system, a central processing unit (CPU) module and a random access memory (RAM) module in working combination.

16. The solar drink holder system of claim 15, further comprising set of instructions; and wherein the solar drink holder is arranged as a kit.

17. A method for using a solar drink holder system, the method comprising the steps of:

providing the solar drink holder system including, a cylindrical device body, having a top and bottom, which receives a hand held thermoelectric temperature controlled beverage receptacle configured to receive and hold only a single cylindrical beverage container;

a Peltier thermoelectric module coupled to said hand held thermoelectric temperature controlled beverage receptacle and configured to regulate internal temperature of a beverage held within said single cylindrical beverage container;

at least one solar panel attached to said cylindrical device body receiving the hand held thermoelectric temperature controlled beverage receptacle; and a hollow base housing coupled to the bottom of the cylindrical device body said hollow base housing including a rechargeable power source, a control panel, at least one USB port, at least one digital display, at least one audio speaker, a short range wireless communication protocol system, a thermal indicator and configured to provide power to the hand held thermoelectric temperature controlled beverage receptacle, the hollow base housing having electronic device charging and wireless sound transmitting capability using the short range wireless communication protocol system;

positioning the at least one solar panel into a deployed position;

connecting an electronic device to be charged to the at least one USB port;

activating the short range wireless communication protocol system via said control panel;

transmitting wireless sound via said at least one audio speaker;

inserting the single cylindrical beverage container into the hand held thermoelectric temperature controlled beverage receptacle; and activating the Peltier thermoelectric module via said control panel to regulate beverage temperature.

18. The method of claim 17, further comprising the steps of positioning the at least one solar panel into a stowed position;

disconnecting the electronic device;

deactivating said short range wireless communication protocol system;

deactivating said Peltier thermoelectric module;

removing said single cylindrical beverage container; and recharging the rechargeable power source via a universal wall charger.

* * * * *